US012805659B1

(12) United States Patent
Hanley et al.

(10) Patent No.: US 12,805,659 B1
(45) Date of Patent: Nov. 24, 2026

(54) FAST FIT CURTAIN ROD BRACKET SYSTEM

(71) Applicant: Kenney Manufacturing Company, Warwick, RI (US)

(72) Inventors: Michael P. Hanley, Smithfield, RI (US); Sally Voas, Albion, RI (US)

(73) Assignee: Kenney Manufacturing Company

( * ) Notice: Subject to any disclaimer, the term of this patent is extended or adjusted under 35 U.S.C. 154(b) by 0 days.

(21) Appl. No.: 18/991,046

(22) Filed: Dec. 20, 2024

Related U.S. Application Data

(60) Continuation of application No. 18/490,706, filed on Oct. 19, 2023, now Pat. No. 12,213,610, which is a division of application No. 18/335,068, filed on Jun. 14, 2023, now Pat. No. 12,193,588, which is a continuation-in-part of application No. 17/819,395, filed on Aug. 12, 2022, now abandoned, which is a continuation of application No. 16/358,204, filed on Mar. 19, 2019, now abandoned.

(60) Provisional application No. 62/644,889, filed on Mar. 19, 2018.

(51) Int. Cl.
*A47H 1/102* (2006.01)
*A47H 1/142* (2006.01)

(52) U.S. Cl.
CPC ..... *A47H 1/102* (2013.01); *A47H 1/142* (2013.01)

(58) Field of Classification Search
CPC ..... A47H 1/102; A47H 1/142; A47H 1/10; A47H 1/12; A47H 1/104; A47H 1/122; A47H 1/124; A47H 1/14; A47H 1/144; A47H 1/02; A47H 2001/021; A47G 25/0607; A47G 25/0635; A47K 2201/00; A47K 2201/02; A47K 2201/025; A47B 96/068; F16B 15/0053
USPC .. 248/262, 261, 220.22, 314, 223.41, 224.7; D8/363
See application file for complete search history.

(56) References Cited

U.S. PATENT DOCUMENTS

| | | | |
|---|---|---|---|
| 102,945 | A | 5/1870 | Judd et al. |
| 229,873 | A | 7/1880 | Day |
| 232,644 | A | 9/1880 | Judd |
| 241,991 | A | 5/1881 | Jones |
| 275,481 | A | 4/1883 | Gould |

(Continued)

FOREIGN PATENT DOCUMENTS

| | | | |
|---|---|---|---|
| EP | 0219648 | A1 | 4/1987 |
| EP | 0229497 | A1 | 7/1987 |

(Continued)

OTHER PUBLICATIONS

Non-Final Office Action received for U.S. Appl. No. 18/490,706, mailed on Dec. 28, 2023, 24 pages.

(Continued)

*Primary Examiner* — Ingrid M Weinhold
(74) *Attorney, Agent, or Firm* — Adler Pollock & Sheehan P.C.

(57) ABSTRACT

Methods for installing curtain rod brackets and secure curtain rods to a wall with the curtain rod brackets. The methods involve installation of one or more curtain rod brackets having a back portion, an arm and a curtain rod cradle, and a fastening plate that is configured to engage a wall. The back portion is configured to slidably receive the fastening plate, and includes a channel formed with a pair of opposing side rails, an upper stop and a lower opening.

10 Claims, 8 Drawing Sheets

(56) References Cited

U.S. PATENT DOCUMENTS 374,340 A 12/1887 Brass
378,087 A 2/1888 Field
D23,731 S 10/1894 Burgess
568,048 A * 9/1896 Starbuck ..... A47H 1/122 248/265
606,442 A 6/1898 Bullis
639,439 A 12/1899 Rush
762,594 A 6/1904 Michaels
762,733 A 6/1904 Malmquist
769,859 A 9/1904 Fanning
789,897 A 5/1905 Borg
819,362 A 5/1906 Miller
824,067 A 6/1906 Dennis
827,272 A 7/1906 Tait
827,627 A 7/1906 Graham
841,550 A 1/1907 Leonard
885,143 A 4/1908 Conrad
917,601 A 4/1909 Heinrichs
937,457 A 10/1909 Moffat
965,658 A 7/1910 Reubel
969,051 A 8/1910 Garraway et al.
1,033,440 A 7/1912 Moffat
1,049,355 A 1/1913 Haller
1,057,043 A 3/1913 Dohm
1,095,551 A 5/1914 Collier
1,141,757 A 6/1915 Bitting
1,147,355 A 7/1915 Zevin
1,185,587 A 5/1916 Bragg et al.
1,249,955 A 12/1917 Hendrickson et al.
1,392,405 A 10/1921 Dougherty
D60,744 S 3/1922 Weyman
1,445,372 A 2/1923 Wallace
1,475,576 A 11/1923 Stephen
1,529,335 A 3/1925 William et al.
D70,831 S 8/1926 Dlouhy
1,616,957 A 2/1927 Honigbaum
1,651,392 A 12/1927 Honigbaum
1,665,785 A 4/1928 Illch
D75,598 S 6/1928 Priest
D76,096 S 8/1928 Vermillion
D76,097 S 8/1928 Vermillion
D76,109 S 8/1928 Vermillion
D76,546 S 10/1928 Madvig
1,794,700 A 3/1931 McCaskey
2,219,075 A 10/1940 Le
2,224,008 A 12/1940 Henry
2,240,225 A 4/1941 Place
2,261,505 A 11/1941 Schlesinger
2,298,380 A 10/1942 Hood
2,448,137 A 8/1948 Cody
2,588,009 A 3/1952 Jones
2,679,373 A 5/1954 Henley
2,693,927 A 11/1954 Gardner
2,751,807 A 6/1956 Stausgaard
2,789,783 A 4/1957 Jones
2,859,879 A 11/1958 Rogers et al.
2,893,676 A 7/1959 Connors et al.
2,908,471 A 10/1959 McFerrell
2,909,352 A 10/1959 Buren
2,964,277 A 12/1960 Sonntag
2,965,339 A 12/1960 Denton
3,003,734 A * 10/1961 Davis ..... A47G 23/0225 248/223.31
3,131,251 A 4/1964 Ryan
3,298,651 A 1/1967 Passer
3,506,135 A 4/1970 Klingaman
3,596,861 A 8/1971 Baldini
3,614,045 A 10/1971 Cegielski
3,622,116 A 11/1971 Fellows
3,669,395 A 6/1972 Gehrke
3,733,043 A 5/1973 Binns
3,848,843 A 11/1974 Levy
3,861,631 A 1/1975 Shorin
3,861,639 A 1/1975 Morrill
3,889,912 A 6/1975 Ray
3,912,211 A 10/1975 Topf
3,928,894 A 12/1975 Bury et al.
3,966,157 A 6/1976 Corral et al.
3,991,963 A 11/1976 Solo
D244,668 S 6/1977 Tegner
4,103,854 A 8/1978 Pliml et al.
4,140,294 A 2/1979 Zwarts
4,162,721 A 7/1979 Moriya
D256,864 S 9/1980 Mitts et al.
D259,241 S 5/1981 Lynch et al.
4,300,745 A 11/1981 Peterson
4,319,531 A 3/1982 Caldwell
4,322,050 A 3/1982 Roach
4,325,528 A 4/1982 Martin
4,333,625 A 6/1982 Haug
D265,285 S 7/1982 Englert
4,340,199 A 7/1982 Brock
4,381,578 A 5/1983 Glejf
4,441,433 A 4/1984 Caldwell
4,485,995 A 12/1984 Hogg
4,509,713 A 4/1985 Hogg
D279,450 S 7/1985 Chap
4,555,432 A 11/1985 Bossons
D281,575 S 12/1985 Chap
4,585,199 A 4/1986 Chap
4,591,125 A 5/1986 Bellehumeur
4,606,526 A 8/1986 Rabinowitz
D285,410 S 9/1986 Webber
4,662,593 A 5/1987 Shames et al.
D290,224 S 6/1987 Skinner
D290,931 S 7/1987 Powell
4,684,095 A 8/1987 Athey
4,718,625 A 1/1988 Boda
4,883,247 A 11/1989 Crandall
4,898,409 A 2/1990 Carter
D307,539 S 5/1990 Greenhut et al.
4,979,713 A 12/1990 Bell
5,000,411 A 3/1991 Primeau
D315,862 S 4/1991 Specker
D316,031 S 4/1991 Goodman et al.
5,011,030 A 4/1991 Alaurent
5,018,697 A 5/1991 Treanor et al.
5,028,030 A 7/1991 Lewis
5,069,412 A 12/1991 Jacob
D327,642 S 7/1992 Foubister
D329,372 S 9/1992 Wilms
5,149,037 A 9/1992 Smith
5,178,355 A 1/1993 Herzig
D334,135 S 3/1993 Fraker et al.
5,244,186 A 9/1993 Chandler
D346,950 S 5/1994 Dunn et al.
5,351,842 A 10/1994 Remmers
5,398,900 A 3/1995 Schober
5,433,416 A 7/1995 Johnson
5,480,120 A 1/1996 Bruner
5,542,641 A 8/1996 Donovan
5,549,407 A 8/1996 Levi et al.
D373,719 S 9/1996 Lin
5,564,666 A 10/1996 Pfeil
5,582,303 A 12/1996 Sloan
D389,035 S 1/1998 Smiley et al.
5,788,200 A 8/1998 Jones
5,876,147 A 3/1999 Longo
D411,737 S 6/1999 Vogt
5,921,518 A 7/1999 Bernardi
6,042,078 A 3/2000 Donovan
6,126,126 A 10/2000 McKiernan
D433,619 S 11/2000 Rowan
6,206,074 B1 3/2001 Liu
6,216,889 B1 4/2001 Chang
6,302,614 B1 10/2001 Tseng
D454,481 S 3/2002 Deline
D455,334 S 4/2002 Ivankovic
6,371,427 B1 4/2002 Johnson
D459,978 S 7/2002 Hollinger
6,431,510 B1 8/2002 Lydecker
6,439,520 B1 8/2002 Johnson
6,520,463 B1 2/2003 Ouano
6,629,680 B2 10/2003 Weck et al.

(56) References Cited

U.S. PATENT DOCUMENTS 6,641,106 B2 11/2003 Beaty et al.
6,641,344 B2 11/2003 Weiss
6,695,276 B2 2/2004 Skorka
6,719,260 B1 4/2004 Hart
D495,589 S 9/2004 Goodman et al.
6,810,538 B2 11/2004 Ouyoung
D511,088 S 11/2005 Chiu
D516,900 S 3/2006 Hoernig
D517,402 S 3/2006 Cairns
7,128,124 B2 10/2006 Bibby et al.
7,198,088 B2 4/2007 McMenamin et al.
D544,785 S 6/2007 Janssen
D552,455 S 10/2007 Moore
7,287,734 B2 10/2007 Bell
D554,982 S 11/2007 Wenck
D557,595 S 12/2007 Ernst et al.
7,370,839 B2 5/2008 Putman
D572,574 S 7/2008 Lee
7,431,067 B2 10/2008 Nien
7,431,258 B2 10/2008 Lamotta
7,497,028 B2 3/2009 Nevers et al.
D591,143 S 4/2009 Ernst et al.
7,540,458 B2 6/2009 Forbes
D605,931 S 12/2009 Piersant
D605,932 S 12/2009 Piersant
D608,620 S 1/2010 Morgenroth
7,686,273 B2 3/2010 Christodoulou
7,699,278 B2 4/2010 Goldstein
D622,578 S 8/2010 Kollman
7,798,463 B2 9/2010 Morgenroth
D632,951 S 2/2011 McGreevy et al.
7,926,127 B2 4/2011 Barrese
D649,025 S 11/2011 Gingery
D649,437 S 11/2011 McDuff et al.
8,056,873 B1 11/2011 Hanley et al.
D650,261 S 12/2011 McDuff et al.
8,231,093 B2 7/2012 Tran
D668,136 S 10/2012 Nicholls et al.
8,356,782 B2 1/2013 Robichaud et al.
D678,754 S 3/2013 Burr
8,418,975 B1 4/2013 Burr
8,469,207 B2 6/2013 Rowan et al.
8,500,078 B2 8/2013 Castellanos
D700,827 S 3/2014 Starck
8,672,286 B2 3/2014 Darréet al.
8,678,068 B1 3/2014 Hobart et al.
D707,535 S 6/2014 Burr
8,740,171 B2 6/2014 Crescenzo
8,814,114 B2 8/2014 Baines
8,827,587 B2 9/2014 Didehvar
D714,622 S 10/2014 Pan
D715,133 S 10/2014 Pan
D715,625 S 10/2014 Pan
D715,626 S 10/2014 Pan
8,851,435 B1 10/2014 Bastien et al.
8,925,747 B1 1/2015 Hanley
8,960,456 B2 2/2015 Didehvar
9,044,110 B2 6/2015 McDuff et al.
9,138,083 B1 9/2015 Hickey
D742,726 S 11/2015 Glass et al.
9,261,229 B2 2/2016 Callif et al.
D760,068 S 6/2016 Sehl
9,388,837 B1 7/2016 Hanley
9,427,102 B2 8/2016 Weaver
9,429,178 B2 8/2016 Hampel et al.
D767,378 S 9/2016 Sehl
9,609,974 B2 4/2017 Mateer
9,687,092 B2 6/2017 Cabanes
9,775,450 B2 10/2017 Will et al.
D808,779 S 1/2018 Shoenhair et al.
D817,152 S 5/2018 Ng et al.
10,047,787 B2 8/2018 Cheng
10,123,647 B1 11/2018 Mustafa
10,206,526 B1 2/2019 Blakeslee
10,228,080 B2 3/2019 Zvak
10,258,180 B2 4/2019 Malott et al.
10,322,690 B2 6/2019 Wang
D858,259 S 9/2019 Hanley
D858,260 S 9/2019 Hanley
10,539,266 B2 1/2020 Will et al.
10,542,835 B1 1/2020 Suozzo
10,624,474 B2 4/2020 Taratuta
10,648,492 B2 5/2020 Hanley
10,687,639 B2 6/2020 Kan
10,709,279 B1 7/2020 Hammer
10,724,678 B1 7/2020 Elliott
10,765,247 B2 9/2020 Moss et al.
10,772,444 B2 9/2020 Stas
11,002,302 B2 5/2021 Hanley
11,092,176 B2 8/2021 Hanley
11,274,790 B2 3/2022 Maclaren-Taylor
D961,371 S 8/2022 Ford et al.
11,578,833 B2 2/2023 Woolman et al.
D999,052 S 9/2023 Berman et al.
11,759,041 B2 9/2023 Berman et al.
D1,012,679 S 1/2024 Burr
11,857,097 B1 1/2024 Burr
11,903,511 B1 2/2024 Burr
12,016,482 B2 * 6/2024 Moss ..... A47H 1/142
12,207,751 B2 * 1/2025 Moss ..... A47H 1/142
2002/0162925 A1 11/2002 Song
2003/0189126 A1 * 10/2003 Hale ..... A47K 10/405 242/596.4
2004/0159766 A1 8/2004 Skorka
2005/0000716 A1 1/2005 Halbert
2005/0218284 A1 10/2005 Kurrasch
2006/0021722 A1 2/2006 Nien
2006/0054288 A1 3/2006 Bibby et al.
2006/0060314 A1 3/2006 Battista
2007/0090244 A1 4/2007 Goldstein
2007/0125923 A1 6/2007 Wong et al.
2007/0186384 A1 8/2007 Broehl et al.
2007/0235622 A1 10/2007 Baran et al.
2008/0029665 A1 2/2008 Bauer
2008/0164393 A1 7/2008 Hung
2008/0210827 A1 9/2008 Samelson
2008/0265123 A1 10/2008 Repac
2008/0290231 A1 11/2008 Repac
2009/0032659 A1 2/2009 Goldstein
2010/0032536 A1 2/2010 Eagan
2010/0038329 A1 2/2010 Pan
2010/0059642 A1 3/2010 McLeod
2010/0224749 A1 9/2010 Tran
2011/0085874 A1 4/2011 Davidowitch
2011/0174948 A1 7/2011 Ward et al.
2011/0266404 A1 11/2011 Hsu et al.
2011/0315842 A1 12/2011 Lin
2012/0024809 A1 2/2012 Rowan et al.
2012/0067837 A1 3/2012 He et al.
2012/0112022 A1 5/2012 Cheng
2012/0119046 A1 5/2012 Hsu et al.
2012/0152872 A1 6/2012 Didehvar
2012/0217362 A1 8/2012 Affonso
2012/0228446 A1 9/2012 Mikovich
2012/0261371 A1 10/2012 Baines
2012/0284914 A1 11/2012 Bauer
2013/0043357 A1 2/2013 McLeod
2013/0082017 A1 4/2013 Tang
2013/0099080 A1 4/2013 Baines
2013/0292349 A1 11/2013 Bucklew et al.
2013/0341474 A1 12/2013 Baines
2014/0103170 A1 4/2014 Zvak
2014/0150313 A1 6/2014 Stevens
2014/0166603 A1 6/2014 Baines
2014/0231604 A1 8/2014 Long
2014/0231606 A1 8/2014 Sobb
2014/0306079 A1 10/2014 Kuo
2014/0346310 A1 11/2014 Yang
2014/0374367 A1 12/2014 Morel
2015/0265086 A1 9/2015 Hanley et al.
2016/0113428 A1 4/2016 Weaver
2016/0242586 A1 8/2016 Mateer
2017/0002973 A1 1/2017 Will et al.
2017/0071390 A1 3/2017 Moss et al.

(56) References Cited

U.S. PATENT DOCUMENTS

| | | | | |
|---|---|---|---|---|
| 2017/0079457 | A1 | 3/2017 | Baines | |
| 2017/0188738 | A1 | 7/2017 | Walker | |
| 2017/0219161 | A1* | 8/2017 | Dempsey | A47G 1/1613 |
| 2017/0332818 | A1 | 11/2017 | Jones | |
| 2018/0064279 | A1 | 3/2018 | Hanley | |
| 2018/0098656 | A1 | 4/2018 | Baines | |
| 2018/0199747 | A1 | 7/2018 | Moss et al. | |
| 2018/0255952 | A1 | 9/2018 | Sollers | |
| 2018/0317672 | A1 | 11/2018 | Taratuta | |
| 2019/0239661 | A1 | 8/2019 | McGowan et al. | |
| 2019/0374057 | A1 | 12/2019 | Maclaren-Taylor | |
| 2020/0281376 | A1 | 9/2020 | Gallien | |
| 2021/0062966 | A1 | 3/2021 | Woolman et al. | |
| 2021/0127884 | A1 | 5/2021 | Walling | |
| 2021/0169241 | A1 | 6/2021 | Hamel et al. | |
| 2021/0207645 | A1 | 7/2021 | Hoffman et al. | |
| 2021/0345808 | A1 | 11/2021 | Berman et al. | |
| 2023/0380619 | A1 | 11/2023 | Berman et al. | |
| 2023/0383901 | A1 | 11/2023 | Hoffman et al. | |
| 2024/0057802 | A1* | 2/2024 | Moss | A47H 1/142 |
| 2024/0122390 | A1* | 4/2024 | Moss | A47H 1/142 |
| 2024/0306835 | A1* | 9/2024 | Moss | A47H 1/142 |
| 2024/0407583 | A1* | 12/2024 | Moss | A47H 1/142 |
| 2025/0251009 | A1* | 8/2025 | Moss | F16B 21/09 |

FOREIGN PATENT DOCUMENTS

| | | | |
|---|---|---|---|
| EP | 1619397 | A1 | 1/2006 |
| EP | 1748196 | A1 | 1/2007 |
| GB | 2289983 | A | 12/1995 |
| JP | S629405 | U | 1/1987 |
| JP | S6295483 | A | 5/1987 |
| JP | H0784052 | | 3/1995 |
| JP | 2002207080 | A | 7/2002 |
| JP | 2005257437 | A | 9/2005 |
| WO | 9827443 | A1 | 6/1998 |
| WO | 2009039578 | A1 | 4/2009 |
| WO | 2019141969 | A1 | 7/2019 |

OTHER PUBLICATIONS

Melissa, "Why Screws Tighten Clockwise", Retrieved from https://gizmodo.com/why-screws-tighten-clockwise-1639456879, Sep. 26, 2014, 5 pages.

* cited by examiner

FAST FIT CURTAIN ROD BRACKET SYSTEM

CROSS REFERENCE TO RELATED APPLICATIONS

This application is a continuation of U.S. patent application Ser. No. 18/490,706, filed Oct. 29, 2023, which is a divisional of U.S. patent application Ser. No. 18/335,068, filed Jun. 14, 2023, which is a continuation-in-part of U.S. patent application Ser. No. 17/819,395, filed Aug. 12, 2022, which is a continuation of U.S. patent application Ser. No. 16/358,204, filed Mar. 19, 2019, and claims benefit from U.S. Provisional Patent Application Ser. No. 62/644,889, filed Mar. 19, 2018. All of these applications are incorporated by reference in their entireties.

STATEMENT REGARDING GOVERNMENT INTEREST

None.

BACKGROUND OF THE INVENTION

The present invention relates generally to curtain rods, and more particularly to an easily and quickly installed bracket for use with curtain rods.

In general, curtain rods and such are hung on brackets. In a typical installation, a bracket is placed in a desired position against a wall, the bracket secured to the wall using nails and/or screws, and a curtain rod positioned and suspended securely across the bracket. At a minimum, the installation of the bracket requires a hammer and/or a screwdriver to fixate the nails and/or screws and reasonable manual dexterity to secure the bracket to the wall. More specifically, the bracket is positioned on the wall, nails and/or screws are tap and/or screwed into the wall, and curtain and rod are hung on the bracket.

What is needed is a system that eases an installation of a curtain rod bracket to a wall structure.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In general, in one aspect, the invention features a method comprising the steps of (1) providing a curtain rod bracket assembly comprising: (a) a back portion having a front surface and a channel with an upper stop member, first and second opposed side rails descending from the upper stop member, and a lower opening between the first and second side rails, (b) a first arm extending outward from a first portion of the front surface, and including a first end engaging the first portion and a second end opposite the first end, (c) a curtain rod receptacle engaging the second end of the first arm, and (d) a fastening plate configured to slidably engage the back portion channel, and configured to engage a wall, the fastening plate including first and second apertures dimensioned to receive first and second securing objects therein, respectively; (2) positioning the fastening plate of the curtain rod bracket assembly against the wall; (3) inserting the first securing object of the curtain rod bracket assembly into the first aperture of the fastening plate of the curtain rod bracket assembly; (4) urging the first securing object of the curtain rod bracket assembly through the first aperture of the fastening plate of the curtain rod bracket assembly, whereby the first securing object enters the wall until a small portion of the first securing object is protruding out of the first aperture of the fastening plate of the curtain rod bracket assembly; (5) inserting the second securing object of the curtain rod bracket assembly into the second aperture of the fastening plate of the curtain rod bracket assembly; (6) urging the second securing object of the curtain rod bracket assembly through the second aperture of the fastening plate of the curtain rod bracket assembly, whereby the second securing object enters the wall until a small portion of the second securing object is protruding out of the second aperture of the fastening plate of the curtain rod bracket assembly; (7) sliding the back portion of the curtain rod bracket assembly onto the fastening plate of the first curtain rod bracket assembly such that the channel of the back portion receives the fastening plate therein, whereby the back portion of the curtain rod bracket assembly is secured to the fastening plate of the curtain rod bracket assembly and thus to the wall; and (8) positioning a curtain rod within the curtain rod receptacle of the curtain rod bracket assembly.

In another aspect, the invention features a method comprising the steps of (1) providing a curtain rod bracket assembly comprising: (a) a back portion having a front surface and a channel with an upper stop member, first and second opposed side rails descending from the upper stop member, and a lower opening between the first and second side rails, (b) a first arm extending outward from a first portion of the front surface, and including a first end engaging the first portion and a second end opposite the first end, (c) a curtain rod receptacle engaging the second end of the first arm, and (d) a fastening plate configured to slidably engage the back portion channel, and configured to engage a wall, the fastening plate including first and second apertures dimensioned to receive first and second securing objects therein, respectively; (2) positioning the fastening plate of the curtain rod bracket assembly against the wall; (3) inserting the first securing object of the curtain rod bracket assembly into the first aperture of the fastening plate of the curtain rod bracket assembly; (4) urging the first securing object of the curtain rod bracket assembly through the first aperture of the fastening plate of the curtain rod bracket assembly, whereby the first securing object enters the wall until a small portion of the first securing object is protruding out of the first aperture of the fastening plate of the curtain rod bracket assembly; (5) inserting the second securing object of the curtain rod bracket assembly into the second aperture of the fastening plate of the curtain rod bracket assembly; (6) urging the second securing object of the curtain rod bracket assembly through the second aperture of the fastening plate of the curtain rod bracket assembly, whereby the second securing object enters the wall until a small portion of the second securing object is protruding out of the second aperture of the fastening plate of the curtain rod bracket assembly; and (7) sliding the back portion of the curtain rod bracket assembly onto the fastening plate of the first curtain rod bracket assembly such that the channel of the back portion receives the fastening plate therein, whereby the back portion of the curtain rod bracket assembly is secured to the fastening plate of the curtain rod bracket assembly and thus to the wall.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
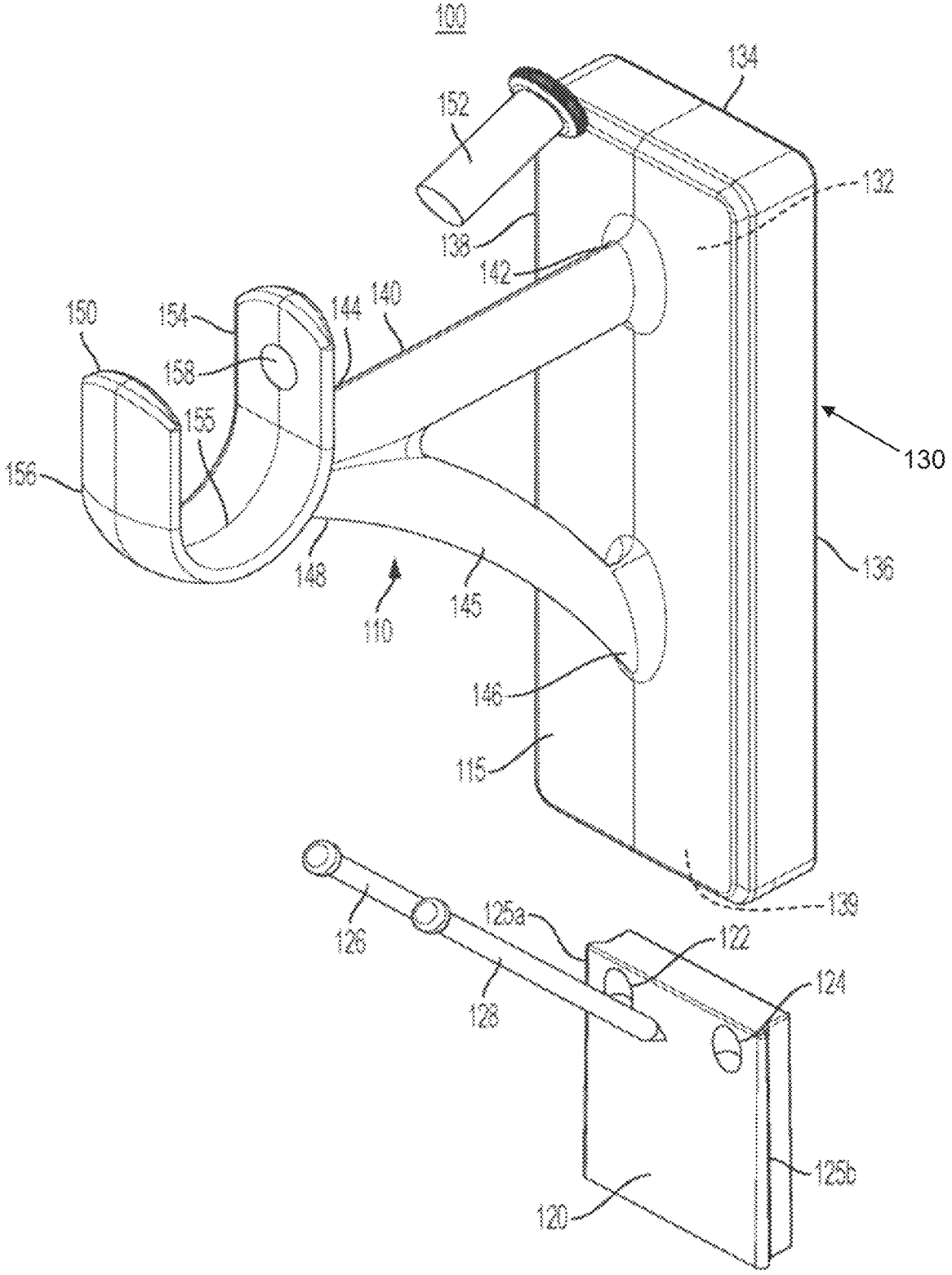
FIG. 1 is an illustration of a first embodiment of an exemplary fast fit bracket system.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

As shown in FIG. 1, a first embodiment of an exemplary fast fit bracket system 100 includes a bracket 110 and a fastening plate 120 having apertures 122, 124 to receive finishing nails 126, 128, respectively. It should be appreciated that the shape and design of the bracket 110 can vary. In addition, it should be appreciated that the finishing nails 126, 128 may be replaced with other securing objects, such as screws. In the example embodiment, the bracket 110 includes a back portion 130, a first arm 140, a second arm 145 and a curtain rod cradle 150. The back portion 130 comprises a front surface 115 and includes a channel 132 formed with a pair of opposing side rails 136, 138, an upper stop member 134 and a lower opening 139. The first arm 140 extends outward from a first portion of the front surface 115 and includes a first end 142 engaging the first portion and a second end 144 opposite the first end 142. The second arm 145 extends outward from a second portion of the front surface 115, the second portion being spaced from the first portion, and includes a third end 146 engaging the second portion and a fourth end 148 opposite the third end 146. The curtain rod cradle 150 is configured to receive a curtain rod (not shown) that is secured within the curtain rod cradle 150 with a rod support set screw 152. The curtain rod cradle 150 is U-shaped, and has first and second vertical members 154, 156 and a base 155 extending between the first and second vertical members 154, 156. The first vertical member 154 has a hole 158 formed therein and is attached to the second end 144 of the first arm 140, and the fourth end 148 of the second arm 145 is attached to the cradle 150 such that the second end 144 and the fourth end 148 form an acute angle with each other. As will be described further, the bracket 100 is configured to mate with the fastening plate 120 and the fastening plate 120 is secured to a wall structure (not shown) by the finishing nails 126, 128, which insertably engage apertures 122, 124. The fastening plate 120 includes first and second sides, a first flange 125*a* extending outwardly from and along the first side, and a second flange 125*b* extending outwardly from and along the second side.

Figure 2:
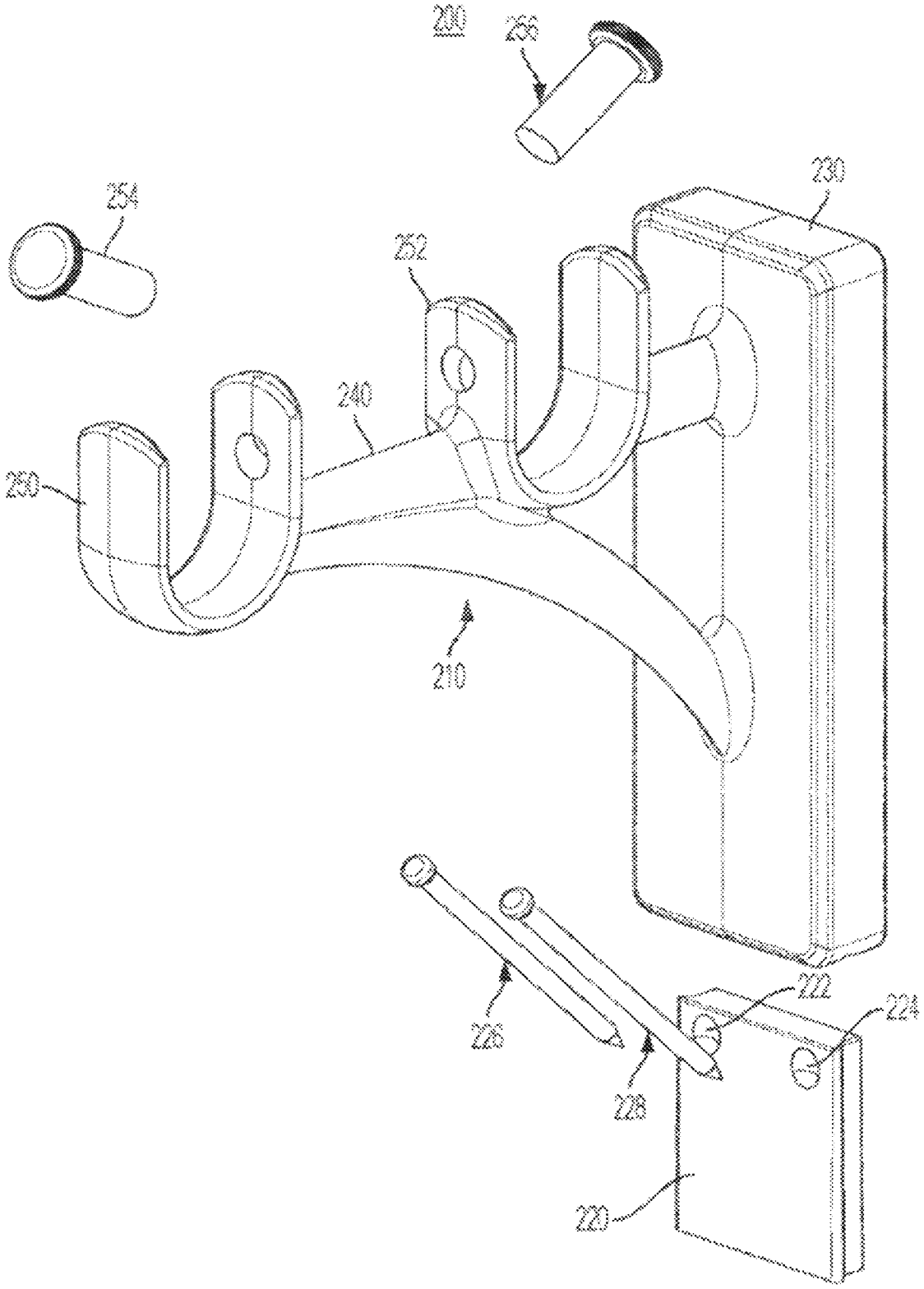
FIG. 2 is an illustration of a second embodiment of an exemplary fast fit bracket system.

As shown in FIG. 2, a second embodiment of an exemplary fast fit bracket system 200 includes a bracket 210 and a fastening plate 220 having apertures 222, 224 to receive finishing nails 226, 228, respectively. In the embodiment shown, the bracket 210 includes a back portion 230, an arm 240, a first curtain rod cradle 250 and a second curtain rod cradle 252. The curtain rod cradles 250, 252 are configured to receive curtain rods (not shown) that are secured within respective curtain rod cradles 250, 252 with rod support set screws 254, 256. As will be described further, the bracket 200 is configured to mate with the fastening plate 220 and the fastening plate 220 is secured to a wall structure (not shown) by the finishing nails 226, 228.

Figure 3:
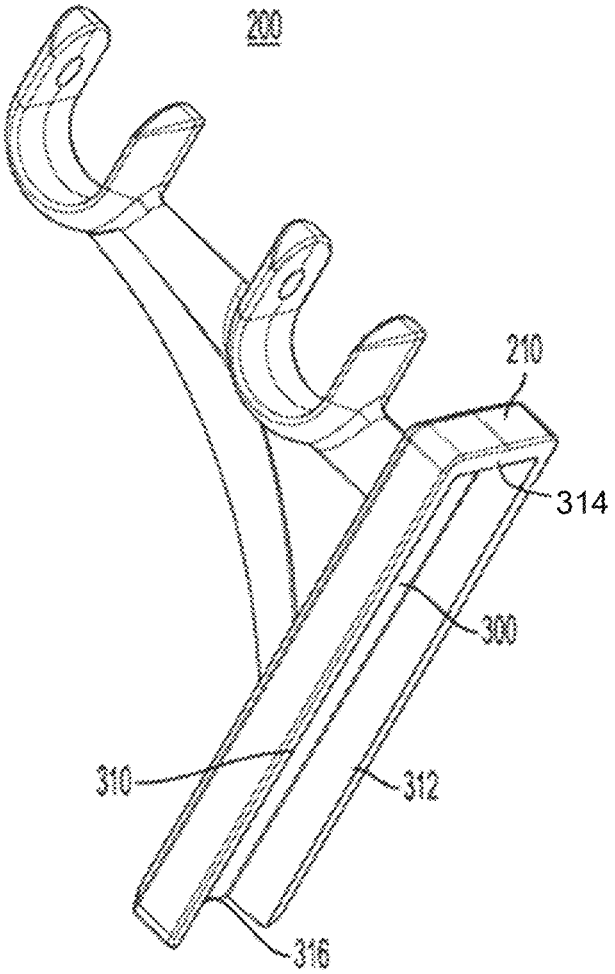
FIG. 3 is an illustration of an exemplary back channel of a bracket.

As shown in FIG. 3, each of the brackets, for example, bracket 210, includes a back portion (i.e., the portion of the bracket 210 opposite the arm 240) configured with a channel 300. The channel 300 is formed by opposing side rails 310, 312 and a top rail 314. A lower portion 316 of the channel is open ended. The channel 300 is sized to snugly receive the fastening plate 220. More specifically, after the fastening plate 220 is secured to a wall structure, the channel 300 of the bracket 210 is slid over the fastening plate 220, securing the bracket 210 to the fastening plate 220 and thus to the wall structure. The top rail 314 of the channel 300 limits upward travel and acts like a stop when the bracket 210 is placed over the fastening plate 220.

Figure 4:
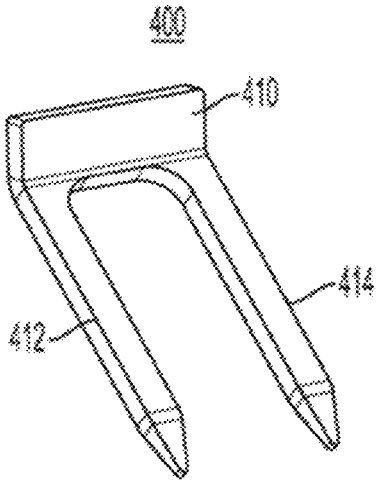
FIG. 4 illustrates an exemplary prong.

The fastening plates 120, 220 shown above, generally require use of a hammer or screwdriver in conjunction with nails or screws to secure the fastening plates 120, 220 to any wall structure. However, manual insertion may be used when the wall structure is standard wall board. But there are times in which a tool-less system would be preferred. Referring now to FIG. 4, in an alternate embodiment, the fastening plates 120, 220 are replaced by a prong 400. The prong 400 includes an exposed portion 410 offset from two penetration portions 412, 414. A user presses the penetration portions 412, 414 into a wall structure and the exposed portion 410 remains visible. The exposed portion 410 is manually placed into the channel 300 until it abuts against the top rail 314, thus securing the bracket 110, 210 to the wall structure.

Figure 5:
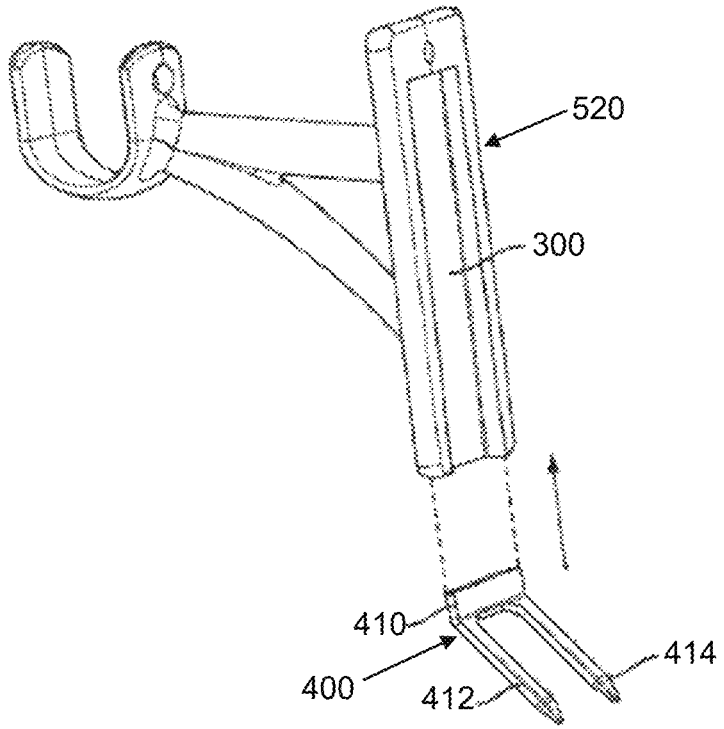
FIG. 5 illustrates an exemplary alignment of a prong relative to channel of a bracket.

In FIG. 5, alignment of a prong 500 is shown relative to a channel 510 of a bracket 520. As described above, the channel 510 is slid over an exposed portion 530 of the prong 500 after penetration portions 540, 542 are placed with in a wall structure.

Figure 6:
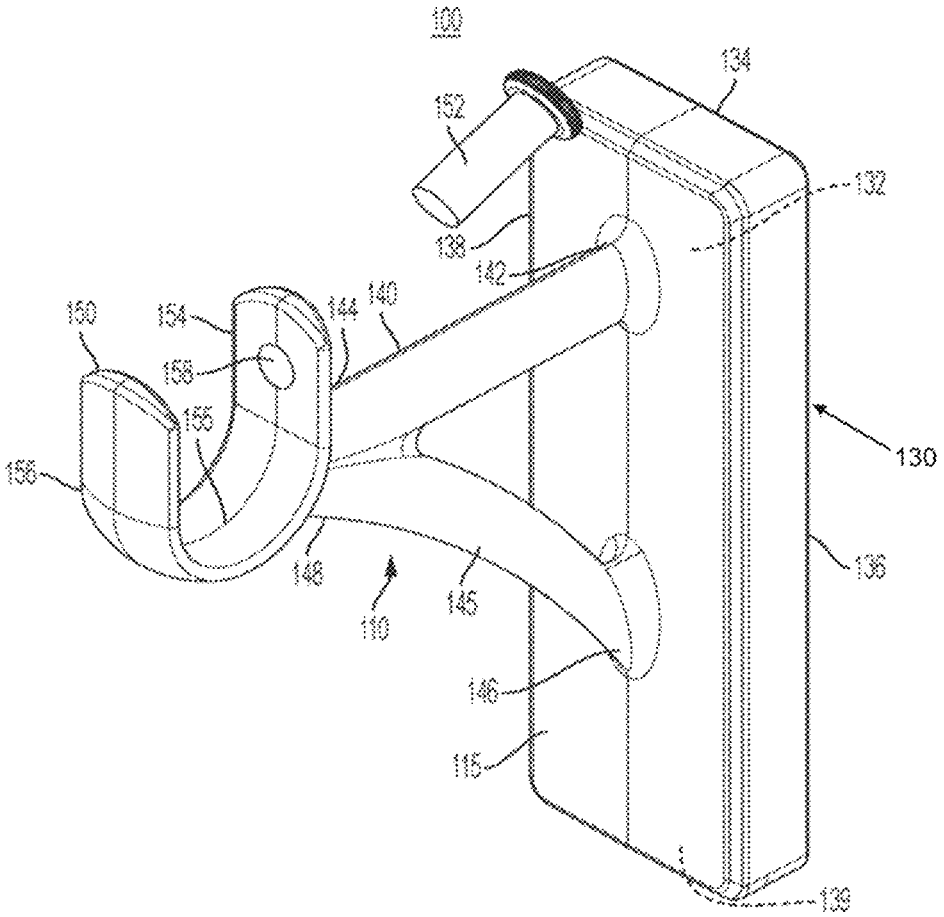
FIG. 6 illustrates an alternate fastening plate.
Figure 6:
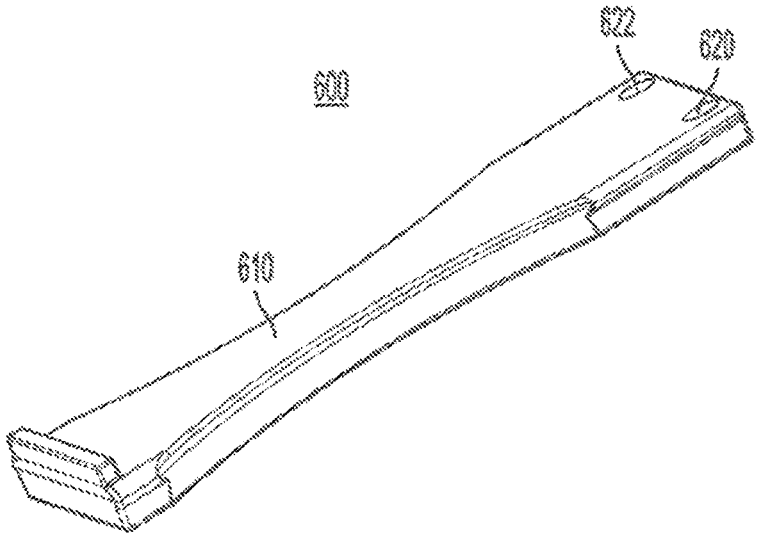

Referring now to FIG. 6, in one embodiment the fastening plates 120, 220 are replaced with a lengthened and shaped fastening plate 600 to increase stability. The fastening plate 600 includes a tapered mid-section 610, an upper portion that includes apertures 620, 622 for use with nails or screws (not shown) that are used to secure the fastening plate 600 to a wall structure (not shown).

Figure 7:
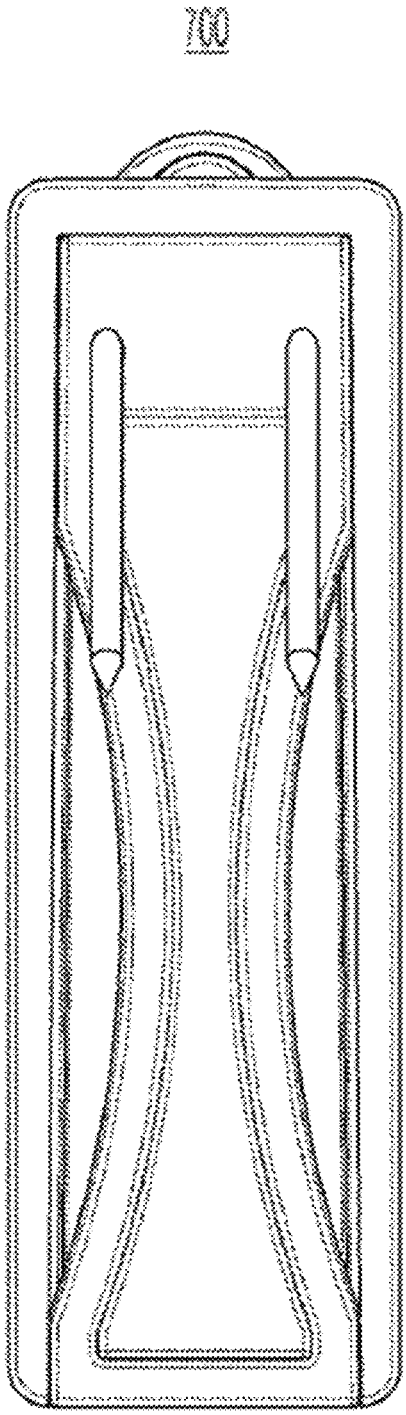
FIG. 7 illustrates an exemplary rear view of a fast fit bracket system.
Figure 8:
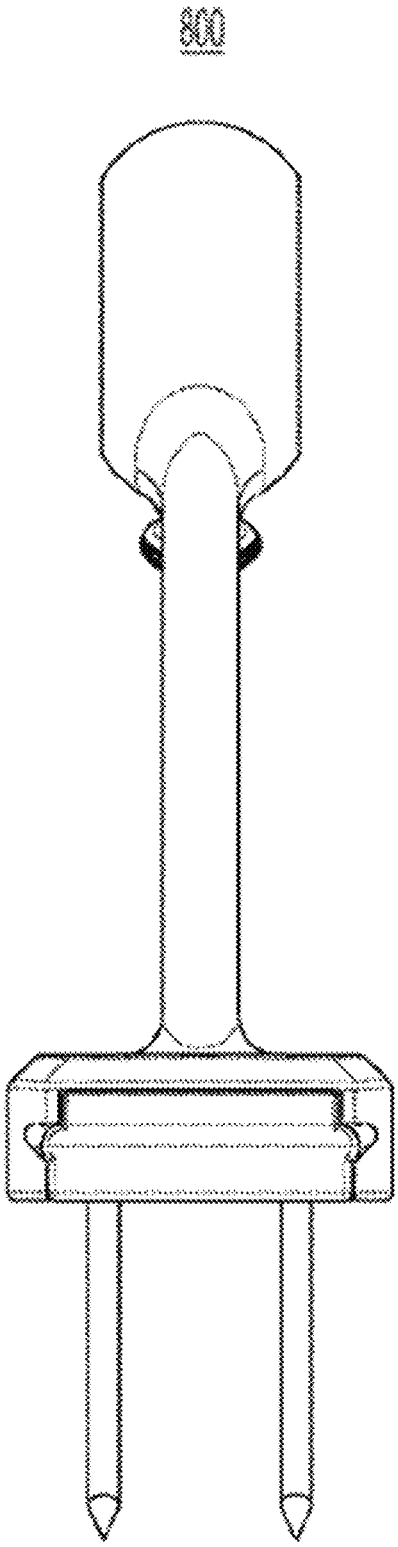
FIG. 8 illustrates an exemplary bottom view of a fast fit bracket system.

FIG. 7 illustrates an exemplary rear view of a fast fit bracket system 700 and FIG. 8 illustrates an exemplary bottom view of a fast fit bracket system 800.

Figure 9:
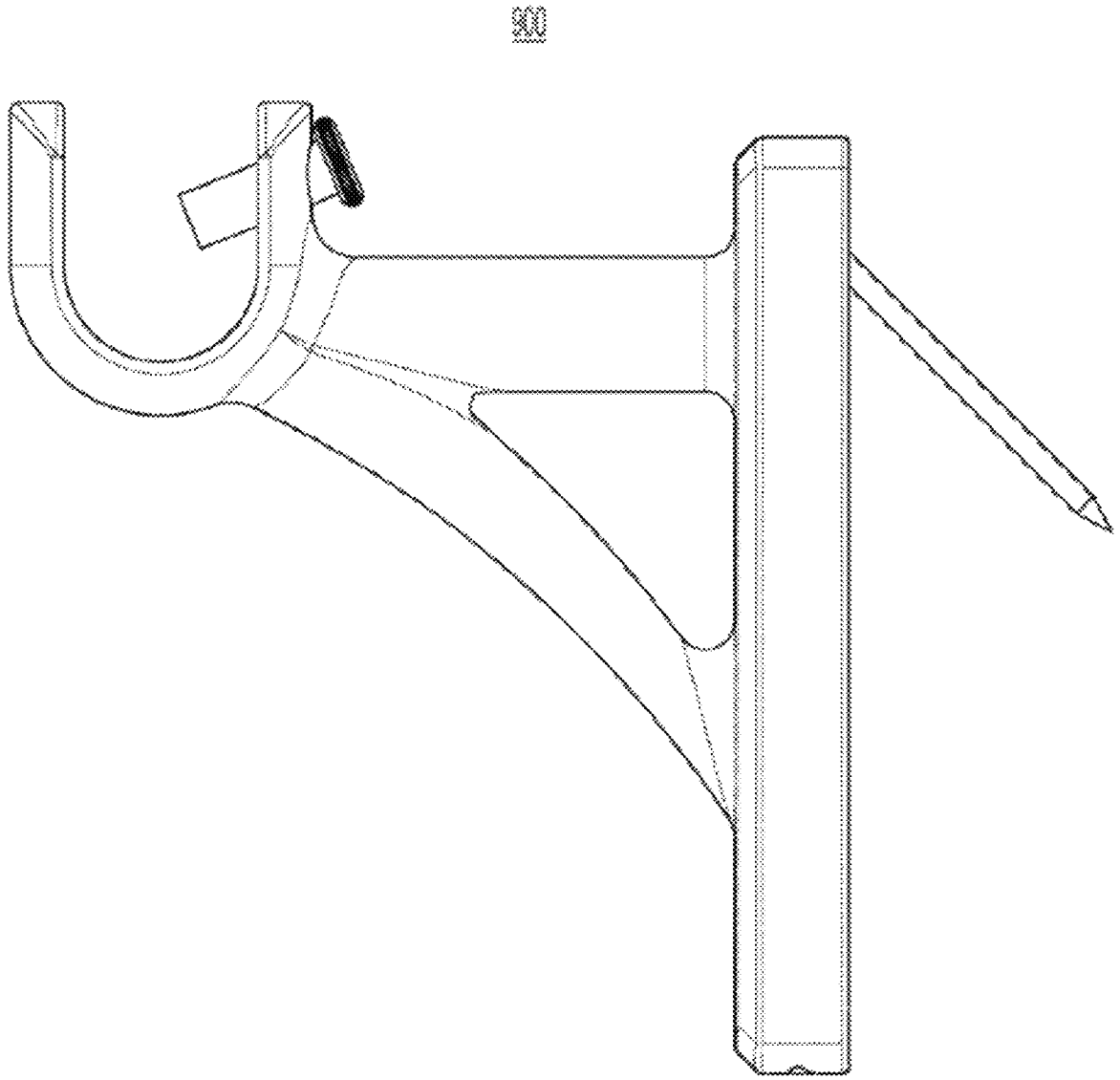
FIG. 9 illustrates an exemplary side view of a fast fit bracket system.

FIG. 9 illustrates an exemplary side view of a fast fit bracket system 900.

The foregoing description of the preferred embodiments of the invention is by way of example only, and other variations of the above-described embodiments and methods are provided by the present invention. The embodiments described herein have been presented for purposes of illustration and are not intended to be exhaustive or limiting. Many variations and modifications are possible in light of the foregoing teaching. The invention is limited only by the following claims.

What is claimed is:

1. A fast fit bracket system comprising:

(a) a bracket comprising:

a back portion having a front surface and a channel with an upper stop member, first and second opposed side rails descending from the upper stop member, and a lower opening between the first and second side rails;

a first arm extending outward from a first portion of the front surface and including a first end engaging the first portion and a second end opposite the first end;

a second arm extending outward from a second portion of the front surface, the second portion being spaced from the first portion, the second arm being curved and including a third end engaging the second portion and a fourth end opposite the third end; and a curtain rod cradle carried by the first and second arms and configured to receive a curtain rod, wherein the curtain rod cradle is U-shaped, has first and second vertical members and a base extending between the first and second vertical members, the first vertical member having a hole formed therein and being attached to the second end of the first arm, and the fourth end of the second arm being attached to the curtain rod cradle such that the second end of the first arm and the fourth end of the second arm form an acute angle with each other;

(b) a fastening plate configured to slidably engage the channel of the back portion and configured to engage a wall, the fastening plate comprising a body having opposite side edges, a lower portion, an upper portion, and a tapered mid-section between the lower portion and the upper portion, the tapered mid-section having a width between the opposite side edges that is less than a width of the lower portion and less than a width of the upper portion, and the upper portion including first and second apertures formed side by side in an upper portion of the fastening plate along a substantially horizontal line between the opposite side edges of the body, wherein the two apertures are the only openings in the fastening plate; and (c) first and second securing objects configured to be received in the first and second apertures, respectively, for securing the fastening plate to the wall, wherein the back portion is configured to be slid onto the fastening plate such that the channel of the back portion receives the fastening plate therein, whereby the back portion is coupled to the fastening plate and thus to the wall.

2. The fast fit bracket system of claim 1, wherein the upper stop member comprises a top rail of the channel configured to act as a stop when the bracket is placed over the fastening plate.

3. The fast fit bracket system of claim 1, wherein the first and second securing objects comprise nails.

4. The fast fit bracket system of claim 1, wherein the first and second securing objects comprise screws.

5. The fast fit bracket system of claim 1, wherein a lower portion of the channel is open-ended and forms the lower opening between the first and second side rails.

6. The fast fit bracket system of claim 1, wherein the curtain rod cradle includes a set screw configured to engage the curtain rod and retain the curtain rod within the curtain rod cradle.

7. The fast fit bracket system of claim 1, wherein the curtain rod cradle is configured to receive an end of the curtain rod.

8. The fast fit bracket system of claim 1, wherein the first arm is substantially perpendicular to the first portion of the front surface.

9. The fast fit bracket system of claim 1, wherein the back portion is substantially rectangular.

10. The fast fit bracket system of claim 1, wherein the first and second side rails are substantially parallel to each other.

* * * * *